United States Patent [19]

Magister

[11] Patent Number: 5,027,981

[45] Date of Patent: Jul. 2, 1991

[54] DISPENSER CARTRIDGE FOR TWO COMPONENT SYSTEM

[76] Inventor: Herbert K. Magister, 112 Palace Street, Whitby, Ontario, Canada, L1N 5E8

[21] Appl. No.: 448,614

[22] Filed: Dec. 11, 1989

Related U.S. Application Data

[63] Continuation-in-part of Ser. No. 224,339, Jul. 26, 1988, abandoned.

[51] Int. Cl.[5] ..... B67D 5/60; B67D 5/52

[52] U.S. Cl. ..... 222/137; 222/145; 222/386; 222/485

[58] Field of Search ..... 222/94, 129, 134, 137, 222/145, 469, 485, 548, 386; 239/414; 141/2, 18

[56] References Cited

U.S. PATENT DOCUMENTS

| | | | |
|---|---|---|---|
| 2,661,871 | 12/1953 | Huenergardt | 222/129 |
| 2,826,339 | 3/1958 | Maillard | 222/137 |
| 3,330,444 | 7/1967 | Raypholtz | 222/137 |
| 4,263,166 | 4/1981 | Adams | 239/414 |
| 4,366,919 | 1/1983 | Anderson | 222/137 |
| 4,819,836 | 4/1989 | Mechenstock | 222/386 |
| 4,846,373 | 7/1989 | Penn et al. | 222/137 |
| 4,871,090 | 10/1989 | Hoffmann | 222/137 |
| 4,913,553 | 4/1990 | Falco | 222/137 |

FOREIGN PATENT DOCUMENTS

| | | | |
|---|---|---|---|
| 351517 | 1/1990 | European Pat. Off. | 222/386 |
| 3435576 | 4/1986 | Fed. Rep. of Germany | 222/386 |
| 983279 | 2/1951 | France | 222/129 |
| 659629 | 2/1987 | Switzerland | 222/386 |

*Primary Examiner*—Robert P. Olszewski
*Assistant Examiner*—Steven M. Reiss

[57] ABSTRACT

A dispenser cartridge containing two components of a two component system wherein the two components have substantially balanced degrees of compressibility, and in a predetermined ratio, the cartridge having co-axial inner and outer chambers containing the respective components, pistons moveable along the chambers for ejecting the respective components, a dispensing end wall extending transversely of the chambers, an elongated valve body formed on the outward side of the dispensing end wall having a transverse valve recess, first and second dispensing openings in the dispensing wall communicating with the inner chamber and outer chamber, a boss formed in the valve body located along the central axis of the inner chamber and having two dispensing passageways, with a partition wall to keep the two components separate, first and second valve openings extending between the valve body and the boss, communicating with respective passageways, a valve plug member received in the valve recess, first and second conduits formed in the plug member communicating between respective dispensing openings, each of the conduits defining a predetermined volume in said predetermined ratio.

13 Claims, 2 Drawing Sheets

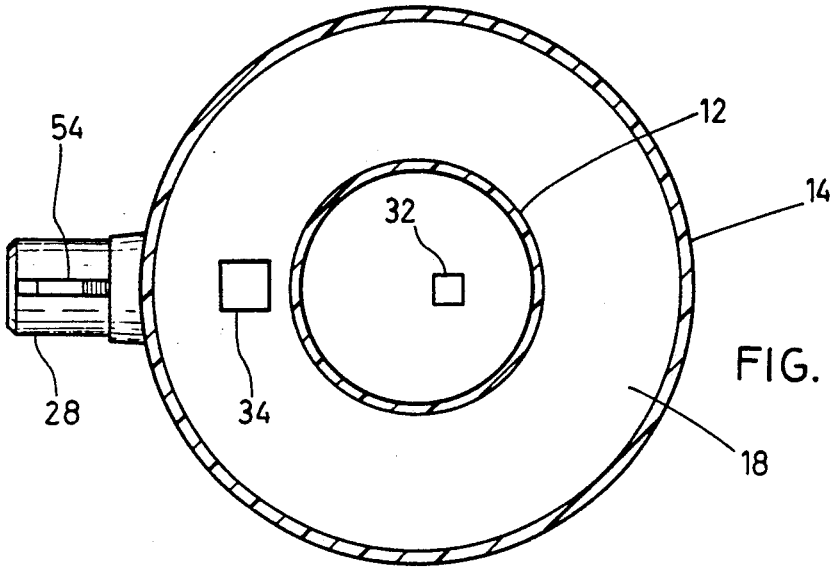
FIG. 3
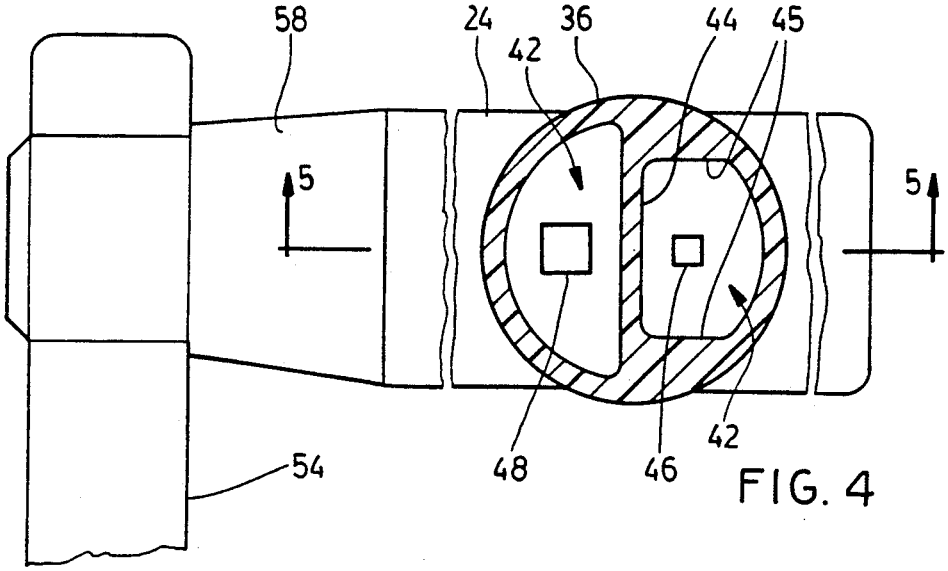
FIG. 4
FIG. 5
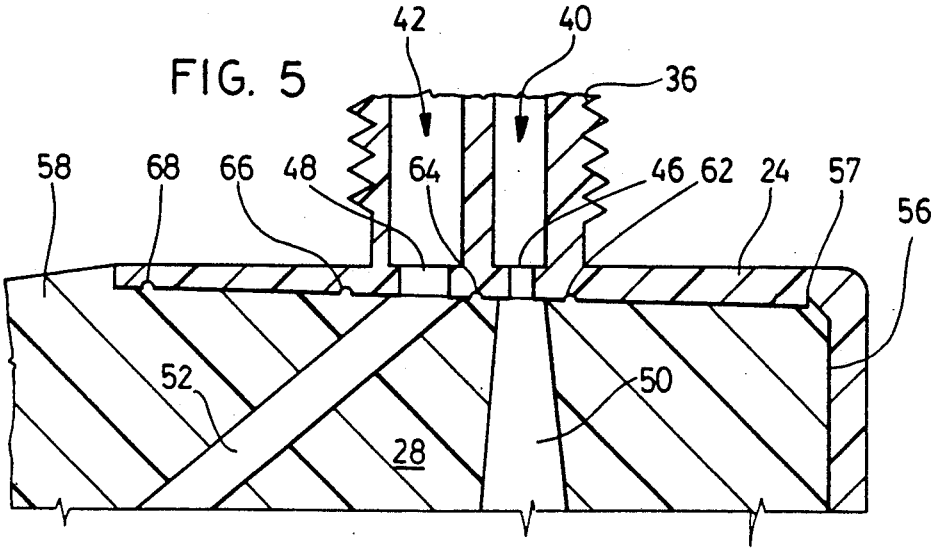

DISPENSER CARTRIDGE FOR TWO COMPONENT SYSTEM

This Application is a Continuation -In-Part of Application Ser. No. 224,339 filed Jul. 26, 1988 for Dispenser Cartridge for Two Component System by Herbert K. Magister, now abandoned.

FIELD OF THE INVENTION

The invention relates to a dispenser cartrideg contains a two-component system, such as a two-component adhesive or the like having degrees of compressibility substantially balanced with one another.

BACKGROUND OF THE INVENTION

Two-component systems such as two-component adhesives require to be stored in two containers so that the two components are kept separate from one another. The two components are then dispensed in appropriate proportions, and mixed, and begin to cure immediately.

Such adhesives are used chiefly in the civil construction industry to grout steel reinforcing bar and anchor bolting rod into existing concrete. The severe service conditions of steel anchorages into concrete and the high potential risk to life in the case of civil structure failure, places high demands on the anchoring adhesive. Field applications of grouting adhesive must necessarily be "fool proof" and must, for all practical purposes, work every time.

In a typical two-component epoxy comprised of an epoxy paste and a curing agent paste, which chemically react over a period of time after contact, forming a finished plastic with very dense molecular linkages between the epoxy and curing agent, and in which, these linkages are three-dimensional. It must be understood that the relationship of the curing agent paste to that of the epoxy is not catalytic, or initiating in any significant way. The principal reaction taking place during cure is a nucleophilic substitution, resulting in a one to one correspondence of curing agent reactive sites to epoxy reactive sites. It is critical to the strength of the cured epoxy that the components are mixed in the proper ratio, and that they are very well mixed.

A crude solution in the past was simply to have two separate tubular containers, and squeeze appropriate equal quantities from each container. An improvement on this expedient has been to provide as it were a double-barrelled container. In this arrangement, two containers were formed as an integral structure side by side. Two parallel nozzles were provided at one end and two pistons were provided which could be forced through the two containers simultaneously.

This was somewhat of an improvement. However, it still resulted in the depositing of two separate quantities of the two components in physically spaced-apart locations. The two quantities of components then had to be mixed by hand.

One of the disadvantages of this system is that the mixing of the two components after the ejection from the containers was messy, and caused waste. In the particular application of two-component adhesives in the securing of fastening systems in bore holes, it is highly desirable to provide a dispenser cartridge for the two-component systems in which the two components are mixed and ejected as a single combined stream, for a single nozzle, which can thus be deposited directly from the nozzle into the interior of the bore hole.

One of the problems is that such paste adhesives are formulated by the addition of solid powders to the resin base and batched under high shear dispresion (a process in which a high rpm blade forces both turbulence of the slurry, and the high shear collision of solid particles into each other at differing speeds, refining, milling and wetting the solid components into the resin).

Air is entrained into the mixture during this process, which results in the finished paste being somewhat compressible. The amount of air entrained in the batch is a complex function of batching conditions and chemical nature of the resins, and the solids being added. Differing air entrainment in the epoxy and amine curing agent pastes results in unbalanced compressibilities of the two components.

When flow is initiated from the rear of the cartridge and the materials are of unbalanced compressibility, both components will come under pressure within their respective chambers, converting the pressure in part ot volumetric flow of the material, and in part to a volume change of the product due to its compressibility. The least compressible paste will leave the cartridge in higher relative amounts at first, and the more compressible component will compress to a higher degree at first, with lower relative volumetric flow. The resulting initial surge from unbalanced paste components will not hold to the mix ratio set forth by the ratio of cross-sectional areas of the two cartridge chambers.

Under continuous flow conditions, the paste components in the effluent will approach the design mix ratio of the system, as the components achieve a dynamically balanced compressibility at the expense of initial mix ratio. The off-ratio surge material will precede the properly proportioned material out of the nozzle.

The converse situation results a flow shut-down, when the flow is discontinued by terminating pressure at the rear of the cartridge. After termination of pressure the compressed materials relax, i.e. expand, and this causes material to continue to flow into the cartidge nozzle. The material will be off-ratio in accordance with the difference in compressibility of the contained materials. Each time flow is initiated, the material will surge high in the less compressible component. Each time flow is terminated, a relaxation of the more compressed material will produce a volume of material which will be off-ratio. This phenomenon presents great concern in achieving successful cured properties of the epoxy under field application.

The volume of off-ratio surge material dispensed at the initial flow and shut down sequences is a function of the degree of compressibility imbalance and also a function of the column length of imbalanced pastes being compressed. A longer column will accentuate the imbalance, resulting in larger volumes of off ratio material. This characteristic limits the workably safe length of cartridges.

One proposal is shown in U.S. Pat. No. 4,366,919. In this arrangement two cylindrical containers are provided - one being a small cylinder, and the other being a larger cylinder, and the smaller cylinder being located within the larger cylinder. A cylindrical boss is provided on the ejection end of the cartridge which is offset to one side of the cartridge. Openings are formed from the larger and the smaller cylinders which communicate with the boss. An ejection nozzle is attached to the boss, for mixing and depositing the material. This offset arrangement makes the cartridge clumsy and inconvenient to use. The force required to eject the contents of the two containers, is applied along the central axis of the two containers. However, since the dispensing nozzle is offset towards the periphery of the two containers, the containers must be firmly held, while the dispensing force is applied. If the container is not firmly held it will slip or twist, and the placing of the nozzle will be inaccurate. Manually operated tools similar to caulking gums have been manufactured but are unsatisfactory. If the nozzle were located centrally, it wuld overcome those disadvantages.

Proposals have been made for cartridge type containers of the co-axial design, in which the dispensing nozzle is located centrally, along the central axis. However, there are certain problems in providing passageways for the ejection of both components, when using a central nozzle. Proposals that have been made in the past have not been completely satisfactory. Typically, proposals of this type have involved substantial waste space at the dispensing end of the container. The two components within the waste space could never be fully ejected, leading to wastage of expensive material.

A further proposal is shown in U.S. Pat. No. 4,846,373. This proposal is similar to that shown in U.S. Pat. No. 4,366,919, except that a valve is incorporated in the boss. In this way, it is hoped that the off ratio flow after termination of the ejection pressure can be prevented. However, this proposal fails to explain how the initial off ratio flow which occurs on startup of the ejection pressure, can be controlled. A more fundamental problem with this proposal is that even with the addition of a valve, the off ratio flow at termination of pressure, will not be completely controlled. Obviously, since the device is being operated by one man, with only two hands, he will have difficulty in simultaneously terminating pressure and, at the same time, operating the valve, while all of the time holding the cartridge in position. Thus, even with this system, there will still be some degree of off ratio flow at termination of pressure, before the valve can be operated.

This may not seem like a significant problem. However, this mixing and ejection nozzle are located downstream of the valve. The mixing and ejection nozzle contain a quantity of adhesive which is relatively significant in relation to the total amount of adhesive to be deposited in any given bore hole. Thus, assuming a cartridge is to be used for depositing quantities of adhesive in a series of bore holes, then each time the nozzle is inserted in a bore hole, there will be an initial quantity of adhesive ejected into the bore hole, which is off ratio, resulting from the off ratio flow at the termination of the previous ejection, followed by a further quantity of adhesive which is off ratio due to the initial off ratio surge due to startup of the ejection pressure. This combination of the two quantities of off ratio flow amount to a very significant fraction of the total of adhesive deposited in any one bore hole. As a result, there will be a significant variation in the strength of the cured adhesive, leading to unreliable results.

A further problem arises in the filling of such cartridges with the two components. The practice is to fill the two chambers of the cartridge through the two ejection nozzles. While this is being done, the two pistons are located at the extreme rear end of the cartridge. Obviously, the air within the cartridge must be released as the material flows in. In the past this has been achieved by simply inserting a pin or needle along one side of each piston to create a small air gap.

This however does not always result in the ejection of 100 percent of the air. This is partly because of the design of the pistons, which incorporate a U-shaped profile along the leading face in order to provide positive ejection of the material. As a result, even when the air is removed by the expedient described above, some air still remains entrapped in this U-shaped profile.

It is, therefore, considered desirable to provide a cartridge containing two components in respective co-axial chambers, with a dispensing nozzle aligned along the central axis of the two containers, and in which the problem of off ratio flows both at startup and termination of ejection pressure, are minimized.

BRIEF SUMMARY OF THE INVENTION

With a view to overcoming these various disadvantages, the invention comprises a dispenser cartridge containing a two-component system, wherein the two components have degrees of compressability which are substantially balanced with one another, said two components being located in two respective co-axial chambers defined by an inner cylindrical container wall containing a first component, and an outer cylindrical container wall containing a second component, said first and second components being in a predetermined ratio to one another and having piston means moveable along said chambers, for ejecting said respective components, and said chambers defining a dispensing end, having a dispensing end wall extending transversely of said chambers, whereby said piston means may sweep both chambers, an elongated valve body formed on the outward side of said dispensing end wall, said valve body having a transverse valve recess formed therein, a first dispensing opening in said dispensing wall communicating between said inner chamber and said valve recess, a second dispensing opening formed in said dispensing wall offset from said central axis of said inner chamber, and communicating between said outer chamber and said valve recess, a boss formed on said valve body and defining an axis located along said central axis of said inner chamber, said boss defining two generally parallel first and second dispersed passageways for respective said components, and a partition wall extending there between, whereby to keep said two components separate from one another, said dispersing passageways defining respective first and second volumes in said predetermined ratio first and second valve openings extending between said valve body and said boss, said first valve opening communicating with one of said passageways, and said second valve opening communicating with the other of said passageways, and said first and second valve openings being located on respective sides of said partition wall of said boss, and a valve plug member shaped and adapted to be received in said valve body, first and second conduits formed in said plug member, said first conduit being adapted to communicate between said first dispersing opening in said dipersing wall and said first valve opening, and said second conduit being adapted to communicate between said second dispersing opening and said second valve opening, and wherein said conduits are of unequal length, and wherein each of said conduits defines a pre-determined volume in said predetermined ratio, and wherein said first and second components are formulated to have respective first and second compressibilities, substantially corresponding to one another.

More particularly, it is an objective of the invention to provide a cartridge for a two-component system wherein said two components have degrees of compressibility which are balanced with one another, having the foregoing advantages and wherein said first conduit is generally tapered from one end of to the other.

More particularly, it is an objective of the invention to provide a cartrige for a two-component system wherein said two components have degrees of compressibility which are balanced with one another, having the foregoing advantages wherein said second conduit extends diagonally to the central axis of said inner chamber.

More particularly, it is an objective of the invention to provide a cartridege for a two-component system wherein said two components have degrees of compressibility which are balanced with one another, having the foregoing advantages wherein the inner and outer chambers are of different sizes, proportioned in relation to the ratio of the two components of the system, and wherein said boss defines dispensing passageways having first and second volumes proportionate to said ratio.

More particularly, it is an objective of the invention to provide a cartridge for a two-component system wherein said two components have degrees of compressibility which are balanced with one another, having the foregoing advantages wherein said valve plug member has a plurality of seals formed there around, whereby to restrict leakage of said components.

More particularly, it is an objective of the invention to provide a cartridge for a two-component system wherein said two components have degrees of compressibility which are balanced with one another, having the foregoing advantages wherein the valve member is received in a recess which is open at one end and is closed at the other thereby further reducing the problem of sealing.

More particularly, it is an objective of the invention to provide a cartridge for a two-component system wherein said two components have degrees of compressibility which are balanced with one another, having the foregoing advantages, and wherein said valve recess is defined by a generally regular conical wall surface, and wherein said valve plug comprises a generally frusto-conical shape, and including a plurality of annular ribs formed thereon, comprising a first pair of ribs encircling said valve plug on either side of said first valve opening, and second pain of annular ribs encircling said body, and enclosing said second valve opening, and a second intermediate rib located between said second pain of ribs, separating one end of said second valve opening from the other end thereof.

More particularly, it is an objective of the invention to provide a method of manufacturing a dispenser cartridge for a two-component system of the type described above, and including the steps first of all moulding generally frusto-conical valve plugs, and allowing same to cool, and subsequently moulding generally concentric inner and outer chambers, having a dispensing end, and having a valve body extending transversely thereof, and defining a generally frusto-conical valve recess, having a generally regular frusto-conical wall, and said valve plug member having a plurality of annular sealing ribs extending therearound spaced apart from one another, and, removing said inner and outer chambers, and said valve body from a mould, while the same is still at an elevated temperature, and, forcing said valve plug into said valve recess, and permitting said components to cool, whereby said annular sealing ribs form mating depressions in said valve body.

It is a further and related objective of the invention to provide a dispenser cartridge for a two component system, wherein said two components have degrees of compressibility which are balanced with one another and further having opening means for bleeding air from each of said chambers, and sealing means for subsequently sealing said bleed openings.

It is a further and related objective of the invention to provide a method of filling said cartridges, wherein said two components are deposited in said two chambers simultaneous, and air is continuosly bled through air bleed means from both said chambers simultaneously, and including the step of after filling said chambers, and bleeding all air therefrom, heat sealing said air bleed openings whereby to close the same permanently.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

FIG. 3 is a section along the line 3—3 of FIG. 1;

FIG. 4 is a section along the line 4—4 of FIG. 1, and,

FIG. 5 is a section greatly enlarged along a portion of the valve body and valve plug member.

DESCRIPTION OF A SPECIFIC EMBODIMENT

Figure 1:
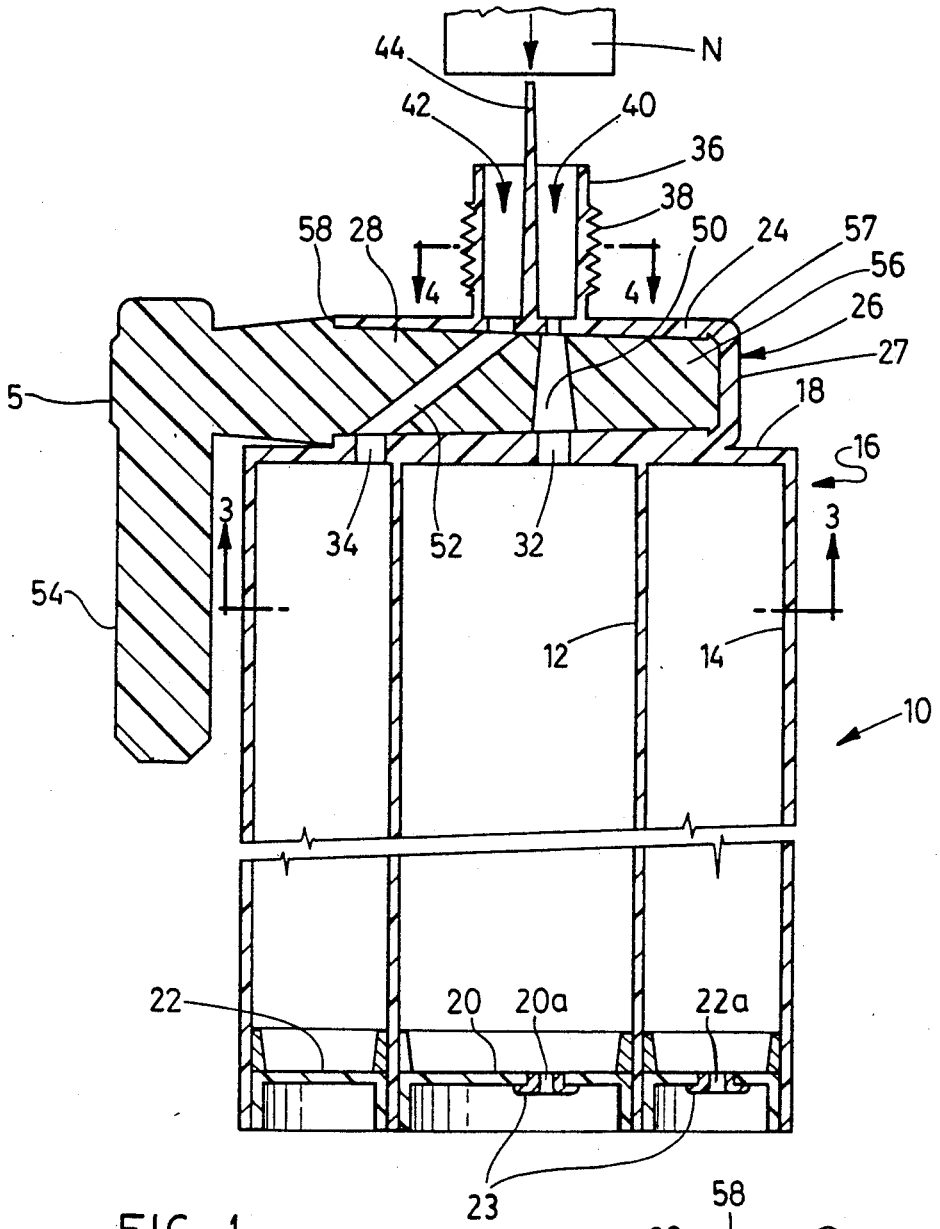
FIG. 1 is a vertical sectional view through a dispenser cartridge in accordance with the invention.

Referring now to FIG. 1, it will be seen that the invention is there illustrated in the form of a dispenser cartridge containing a two-component system. Such systems typically will be two component adhesives, in a semi-liquid or plastic state. It will however be appreciated that the invention is not limited solely to two such component adhesive systems, but is equally applicable to other forms of extrudable material formed in two components, which must be kept separate until applied to a work piece.

In a typical two component adhesive system, the two components will be required to be dispensed and mixed in predetermined proportions. The ratio between the amounts of the two components which are required to be mixed and dispensed will be determined by the manufacturer of the system, and may vary from one such system to another. It is however of considerable importance that in order to acheive the most effective strength for a particular component system, that the components be mixed in the correct ratio as specified by the manufacturer.

In some systems this ratio is 2:1, and in other systems it may be 1:1, but such figures are given merely by way of example and without limitation.

As will appear from the description below, the invention makes provision for acheiving a dispensing of the two components in the pre-determined ratio, so as to acheive optimum results.

For the purposes of this discussion it is assumed that the ratio of the particular system being described is 2:1, but as mentioned above, this figure is merely by way of illustration and without limitation.

The cartridge dispenser is indicated generally as 10, and will be seen to comprise an inner cylindrical wall 12 and an outer cylindrical wall 14 concentric with the central axis of the inner cylindrical wall 12. The two walls 10 and 12 define inner and outer chambers which are concentric with one another. The two chambers will be manufactured with pre-determined volumes, so as to store the two components in the appropriate ratio. The two components are intended to be extruded simultaneously in volumes proportionate to the pre-determined ratio.

It will of course be appreciated that the dimensions of the two chambers shown here are purely by way of illustration. It is not intended that the dimensions of the chambers as illustrated herein shall be precisely to scale. It will be appreciated by persons skilled in the art that the proportioning of the two ratios is a matter of simple mathematics, the two chambers here being shown merely for exemplary purposes.

The two chambers define a dispensing end indicated as 16, and are formed with an integral common transverse dispensing wall 18.

In the typical case the opposite ends of the two chambers are left open, and two moveable pistons namely the inner piston 20 and the outer piston 22 are located in respective inner and outer chambers. The pistons in this case have a generally U-shaped leading end configuration.

In order to bleed air from the two chambers during filling, air bleed holes 20*a* and 22*a* are formed in the respective pistons 20 and 22. On one side or surrounding the air bleed holes, a button 23 of thermoplastic material is intergrally formed with the outer surface of each piston. This material provides a means for sealing the air bleed holes after the two chambers are filled.

By the means of a suitable tool (not shown) the two pistons are engaged simultaneously and may be forced along the two chambers simultaneously towards the dispensing end.

Integrally formed on the outer surface of the dispensing wall 18, there is an elongated valve body 24 defining a tapered valve recess 26 having a blind end 27. Within the recess 26 there is located a valve plug member 28.

In order to communicate the first component from the inner chamber to the valve body, there is provided, in the dispensing wall 18, a first dispensing opening 32 communicating between the inner chamber and the valve recess 26 within the valve body. First opening 32 is located slightly offset to one side of the central axis of the inner container, but may be co-axial.

A second dispensing opening 34 is formed in the dispensing wall 18 communicating with the outer chamber for dispensing the second component. The opening 34 is offset from the central axis of the inner chamber, and in this case is offset to the side of the such central axis, opposite to said first opening.

A generally cylindrically shaped dispensing boss 36 is formed integrally with the valve body 24 aligned coaxially with the inner chamber.

The dispensing boss 36 in this embodiment has a threaded exterior 38. The interior of the boss is hollow, and defines two parallel boss passageways 40 and 42, on opposite sides of a partition wall 44. In this embodiment, the partition wall 44 extends forwardly of the boss in order to maintain a certain degree of separation between the components after they have left the boss.

As will become apparent from the description of operation below, when the cartridge is first operated, the passageways 40 and 42 are, of course, empty. Assuming the cartridge contains components which it is intended to dispense in a 2 to 1 ratio, then in order to maintain the volumes of the two components in their specified ratio, the volumes of the two passageways 40 and 42 will be set in accordance with the ratio of the two components.

Thus if the ratio of the two components is 1:l then the two passageways 40 and 42 would be of equal volume. However, if the ratio is 1:2 as between the first and second component, then the volume of the first passageway 40 will be reduced in relation to the volume of the second passageway 42. This is acheived by the provision of the thickened side walls 45 (FIG. 4) in the passageway 40.

Extending between the valve body 24 and the two boss passageways 40 and 42, are first and second valve openings 46 and 48. (FIG. 4)

The two opening 46 and 48 are offset from one another on opposite sides of the central axis of the inner chamber, and on opposite sides of the wall 44.

As best seen in FIG. 4, the openings 46 and 48 are of rectangular shape, and define predetermined open areas. The open area defined by the second valve opening 48 will be seen to be larger than that of the first valve opening 46.

This is because, in this particular embodiment, the ratio of the two components is 1:2, and thus the ratio of the volumes of the inner and outer chambers is also 1:2, and it is intended that the first and second components shall be dispensed through their respective valve openings in such ratios.

It will also be permissable to make the dispensing openings 32 and 34 (FIG. 3) of predetermined open area, in accordance with the same ratios.

Clearly however, if the ratio to be dispensed is 1:1, then the dimensions of the respective chambers will be rearranged, and the dispensing openings and valve openings will then be of equal size.

In order to communicate the two components from the inner and outer chambers, the valve plug member 28 is provided with a first conduit 50 which is adapted to communicate between the first dispensing opening 32 and the first valve opening 46.

Figure 2:
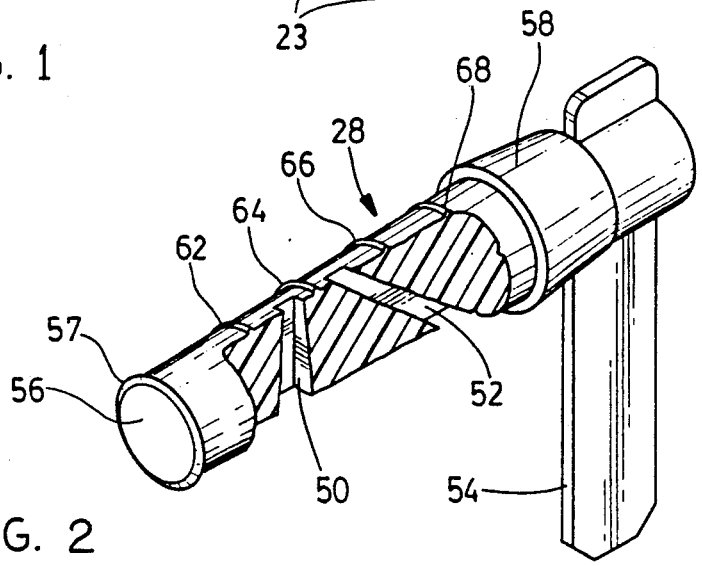
FIG. 2 is an enlarged perspective view partially cut away of the valve plug member of the dispenser shown in isolation.

For reasons to be described below the first conduit 50 is of generally tapered construction, as shown in FIGS. 1 and 2.

In this embodiment, it is offset slightly relative to the central axis of the inner chamber, but it may be co-axial.

A second conduit 52 is provided in valve plug member 28 extending between the second dispensing opening 34 and the second valve opening 48. The second conduit 52 is of regular shape along its length and is located substantially diagonal to the central axis of the inner chamber.

Preferably, the dispensing openings 32 and 34, and the valve openings 46 and 48 are of square cross-section, and the passageway 52 is a square cross-section. The passageway 50 at any given section is of square cross-section, gradually reducing or tapering along its length as shown.

Plug member 28 has an integral handle 54, and a leading end 56 and a trailing end shoulder 58.

It will be observed that the handle 54 lies in a predetermined transverse plane, corresponding to the plane containing the valve opening 46 and 48. This assists the operator in insuring that the valve openings register with the dispensing openings in use.

It also assists the packaging and the shipping of the filled cartridges. When they are shipped and packaged the handle will be extending to one side at 90 degrees. By arranging the cartridges in the carton in a pre-determined fashion, the handle of one cartridge will overlap the shoulder of the next cartridge and so on, thereby preventing the handles from inadvertently becoming opened.

The leading end 56 is provided with a retaining ring 57 adapted to form a mating groove in valve body 24 and then act as a lock and prevent withdrawal of plug member 28 from the valve body.

The trailing end shoulder 58 is somewhat enlarged, and provides a stop.

in accordance with one feature of the invention, the first conduit 50 is somewhat shorter than the second conduit 52. In order to provide them with volumes in the predetermined ratio the first conduit 50 is tapered as shown so that one end is of somewhat larger cross-section than the second conduit 52.

By this feature, when the two pistons are moved in order to dispense the two components, the first component fills the first conduit with a quantity of the component, and the second component fills the second conduit with a quantity of the second component, the two quantities of the two components being in the predetermined ratio.

It will of course be appreciated that the proportioning between the two conduits 50 and 52 will depend upon the ratio of the two component mix, the objective being to ensure that the two components pass into the two passageways in the boss simultaneously in the predetermined ratio. Thus, ejection of the two components into the two passageways in the boss takes place at the same moment, and in the desired ratio of quantities from the beginning.

As best shown in FIG. 5, the valve plug member 28 is formed with a plurality of annular sealing ribs indicated as 62, 64, 66, and 68. The purpose of the ribs is to prevent flow of the two components transversely within the valve body. Clearly, if any such transverse flow took place it might result in combining of the two components, which would then render the valve unusable. The ribs 62 and 64 effect seals on both sides of the conduit 50, and its registering openings.

The ribs 64 and 66 effect seals on both sides of the upper end of the conduit 52. The seals 66 and 68 effect seals on both sides of the lower end of the conduit 52.

The ribs effects seals in the following manner: The valve plug members with their integral ribs are injection moulded in a first operation and are allowed to cool to room temperature or below;

The containers and their associated valve bodies and bosses are then injection moulded in a second operation. The injection moulding process, as is well known, involves the heating of the thermoplastic material to a high temperature at which it is in a plastic flowable state. It is then forced under pressure into a mould, in which it is partially cooled. It is then removed from the mould by opening the mould. When it is removed from the mould, the part is still relatively hot, in many cases too hot to touch. While it is still at an elevated temperature, the cooled valve plug member is then forced into the valve recess. Due to the elevated temperature of the valve body, and the lower temperature of the valve plug, the valve plug will be able to displace plastic material within the valve body. As the valve body cools, it will shrink somewhat and the ribs on the valve plug will then be forced into the surface of the valve recess causing annular indentations or grooves.

In this way, seals are formed which enclose or embrace the ends of each of the valve openings. In the case of the valve opening 50, the seals on either side of this valve opening comprise the seals 62 and 64.

In the case of the diagonal opening 52, the seals comprise the ribs 64, 66, and 68. The ribs 68 and 66 enclosing the one end of the opening 52, and the seals 64 and 66 enclose the other end of the opening 52.

It will also be noted in FIG. 1, that there is indicated partially, a dispensing nozzle N, forming no part of the present invention, but which is normally attached on the boss 36. Typically the nozzle N will contain some form of mixing baffles (not shown) which effectively combine the two components of the system as they flow through the nozzle N.

Once the cartridge has been manufactured and assembled with its valve plug, it is then ready to be filled with the two components. Prior to filling, at least one and preferably both of the components are subjected to a stirring or mixing operation, while maintaining a reduced pressure or vacuum over the surface of the component. In this way, air entrained in the two components is reduced. It is possible to measure the compressibility of each of the components before and after such mixing under vacuum. It is the objective of the vaccum mixing operation to reduce entrained air from the two components in essentially unequal quantities so that the end result is that the two components contain entrained air in quantities which are, substantially corresponding to one another. The end result is that the compressibility of each of the two components in the cartridge will be substantially balanced with one another.

Initially, the process involves adding particulate fillers to the resin. Inevitably, air is entrained into the paste products during the process of wetting and milling particulate fillers into the base resin, under high speed dispersion. Conditions which influence air entrained in the product during dispersion are:

viscosity of base resin blend
shear rate of disperser blade
temperature of resin (changes in process)
type and amount of fillers used
loading schedule (order and speed) of filler addition
dispersion time Due to the dispersion process, air is present in very small bubbles in the finished paste. This material is frequently made so viscous by filler addition that the dispersed air is statically stable in the paste and must be removed by separate process.

Air is removed from the batch by pulling a vacuum over the open top of the container, while using a low speed mixer to cycle the batch contents across the paste/vacuum interface. Air removal rate, and the ultimate air removal, are influenced by the following process variables:

paste temperature
degree of vacuum being pulled
viscosity of resin and finished paste
mixer blade speed vacuum time For a given paste formulation, the compressibility of the finished product may be characterized by density, since this intrinsic value is a strong function of air content. Density is measured by loading the paste into a standard weight-per-gallon cup, and by comparison with the theoretical density of the formulation (free of entrained air), an air content can be established.

In practice, only a few process condition standards are manipulated to influence air content in the finished paste. The dispersion rate, filler loading schedule and dispersion time are modulated to produce an unvacuumed paste at a set point finished temperature. Temperature strongly influences viscosity, an important controllable variable in determining the efficiency of the vacuum process conditions in arriving at finished air content.

Vacuum process conditions typically utilize one mixer speed which as slowly as possible, effectively moves all material in the drum to the surface. Degree of vacuum and vacuum time are standardized as well, to achieve the set-point finished air content for a particular component of the two-part thermosets.

A weight-per-gallon cup density check is used to confirm the designed air content.

In use, the cartridge may be used to deposit a quantity of the two components in for example a bore hole in a sub-strate such as brick, block or concrete, for example. In this case the bore hole will first of all be drilled. A nozzle will then be attached to the boss, and will then be inserted into the bore hole. A suitable tool (not shown) is inserted into the open end of the two chambers simultaneously and pressure is applied to the pistons thereby ejecting quantities of the two components in their predetermined ratios simultaneously into the bore hole.

Since the compressibilities of the two components have been substantially equalized or balanced, and since all of the passageways, for receiving the components from the chambers, are all designed in accordance with the predetermined ratio desired, during start-up, there is substantially no off ratio portion of the mix.

As the two components pass through the nozzle N, they will be combined together, in order to form a reactive two component adhesive system, in a manner well known in the art.

Upon completion of a particular ejection operation, pressure on the two pistons is discontinued, and the valve plug is operated by the handle to close the openings thereby preventing wastage of the two components.

With most operators, there is slight delay between the termination of pressure on the two pistons, and the operation of the valve plug. During this interim, relaxation of the two components occurs, and a small excess quantity of the two components is ejected, from the chambers, before the valve plug can close. However, since the two components have balanced compressibilities, even this small excess flow will not be "off ratio".

Naturally the two components will mix in the nozzle. If the cartridge is to be left unused for any length of time, then the nozzle must be removed and the open end of the boss must then be wiped clean so as to prevent any of the mixed components from hardening in the boss.

When the cartridge is again re-used, usually a fresh dispensing nozzle will be attached.

However, in most cases, the cartridge will be used to treat a large number of bore holes, and in practise the process of ejection from the two chambers, and depositing in the bore hole will be repeated continuously until the cartridge is empty.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A dispenser cartridge containing two components of a two component system, in a pre-determined ratio, said components having degrees of compressibility substantially equalized with one another, and comprising;

first and second chambers enclosing predetermined volumes in said predetermined ratio defining a dispensing end, for containing respective first and second components;

first and second components of said two-component system, located in respective said chambers, said components having degrees of compressibilities substantially equalized with one another;

means associated with said chambers for ejecting the respective components;

a dispensing wall common to said chambers;

an elongated valve body formed on an outward side of said dispensing wall, said valve body having a valve recess formed therein;

a first dispensing opening in said dispensing wall communicating between said first chamber and said valve recess;

a second dispensing opening formed in said dispensing wall communicating between said second chamber and said valve recess;

a boss formed on said valve body and defining two generally parallel dispensing passageways;

first and second valve openings extending between said valve body and said boss, said first valve opening communicating with one of said dispensing passageways, and said second opening communicating with the other of said passageways, and said first and second valve openings being located on opposite sides of said boss and being sized with respect to one another in said predetermined ratio;

a valve plug member shaped and adapted to be received in said valve recess; and first and second valve conduits formed in said valve plug member, said first conduit being adapted to communicate between said first dispensing opening in said dispensing wall and said first valve opening, and said second conduit being adapted to communicate between said second dispensing opening and said second valve opening, and wherein said conduits are of unequal length, and wherein said conduits define volumes with respect to one another substantially corresponding to said predetermined ratio.

2. A dispenser cartridge containing two components of a two-component system in a pre-determined ratio, said components having degrees of compressibility substantially equalized with one another as claimed in claim 1 wherein said first valve conduit is generally tapered from one end to the other.

3. A dispenser cartridge containing two components of a two-component system in a pre-determined ratio, said components having degrees of compressibility substantially equalized with one another as claimed in claim 2 wherein said second valve conduit is of constant cross-section along its length, and extends diagonally with respect to said dispensing passageways.

4. A dispenser cartridge containing two components of a two-component system in a pre-determined ratio, said components having degrees of compressibility substantially equalized with one another as claimed in Claim 3 wherein said first and second valve conduits are of rectangular cross-section.

5. A dispenser cartridge containing two components of a two-component system in a pre-determined ratio, said components having degrees of compressibility substantially equalized with one another as claimed in Claim 4 wherein said first and second dispensing openings and said first and second valve openings are of rectangular shape.

6. A dispenser cartridge containing two components of a two-component system in a pre-determined ratio, said components having degrees of compressibility substantially equalized with one another as claimed in Claim 5 wherein said first and second components are required to be dispensed in predetermined volumes, said predetermined volumes being unequal to one another, and wherein said first and second valve openings define rectangular shapes of predetermined open area, said predetermined open areas being unequal to one another, whereby to permit flow of respective said conduits in said predetermined unequal volumes.

7. A dispenser cartridge containing two components of a two-component system in a pre-determined ratio, said components having degrees of compressibility substantially equalized with one another as claimed in Claim 6 wherein said dispensing passageways in said boss define predetermined volumes, said predetermined volumes being unequal to one another.

8. A dispenser cartride containing two components of a two-component system in a pre-determined ratio, said components having degrees of compressibility substantially equalized with one another as claimed in Claim 7 wherein said plug member and said valve body define a plurality of valve seals, said seals being adapted to seal around both ends of said first conduit, and around both ends of said second conduit.

9. A dispenser cartridge for containing two components of a two-component system in pre-determined ratio, said components having degrees of compressibility substantially equalized with one another as claimed in Claim 1 and wherein said means associated with said chambers comprises pistons formed with air bleed openings for bleeding air from said two containers during filling with said two components.

10. A dispenser cartridge for containing two components of a two-component system in pre-determined ratio, said components having degrees of compressibility substantially equalized with one another as claimed in Claim 1 and wherein said means associated with said chambers comprise pistons formed with air bleed openings for bleeding air from said two chambers during filling with said two components and including abutment means formed on exterior surfaces of said pistons adjacent said air bleed opening, said abutment means being formed of thermoplastic material, and being adapted to be heat-deformable to seal said air bleed openings after filling.

11. A dispenser cartridge containing two components of a two-component system, in a pre-determined ratio, said components having degrees of compressibility substantially equalized with one another, and comprising first and second co-axial chambers defined by an inner cylindrical container wall and an outer cylindrical container wall enclosing predetermined volumes in said predetermined ratio for containing respective first and second components and said chambers defining a dispensing end;

first and second components of said two-component system, located in respective said chambers, said components having degrees of compressibility substantially equalized with one another;

piston means moveable along said chambers for ejecting the respective components;

a dispensing end wall extending transversely of said chambers;

an elongated valve body formed on the outward side of said dispensing end wall said valve body;

a transverse generally frusto-conical valve recess formed transversely in said valve body;

a first dispensing opening in said dispensing wall communicating between said inner chamber and said valve recess;

a second dispensing opening formed in said dispensing wall communicating between said outer chamber and said valve recess offset from said central axis of said inner chamber;

a boss formed on said valve body and defining an axis located along the central axis of said inner chamber said boss defining two gernerally parallel dispensing passageways;

a partition wall extending between said dispensing passageways whereby to keep said two components separate from one another;

first and second valve openings extending between said valve body and said boss, said first valve opening communicating with one of said dispensing passageways, and said second opening communicating with the other of said passageways, and said first and second valve openings being located on opposite sides of said axis of said boss and being sized in said predetermined ratio;

a valve plug member of frusto-conical shape shaped and adapted to be received in said valve recess;

first and second valve conduits formed in said valve plug member, said first conduit defining two ends and being adapted to communicate between said dispensing opening in said dispensing wall and said first valve opening, and said second conduit defining two ends and being adapted to communicate between said second dispensing opening and said second valve opening, and wherein said conduits are of unequal length, and wherein each of said conduits defines a predetermined volume in said predetermined ratio;

a plurality of valve annular ridges on said plug member formed therearound, extending around both ends of said first conduit, and around both ends of said second conduit therein, and, annular valve seal grooves formed in said frusto-conical valve recess registering with respective said ridge seals and co-operating therewith for sealing between respective first and second openings.

12. A dispenser cartridge containing two components of a two-component system, in a pre-determined ratio, said components having degrees of compressibility substantially equalized with one another, and comprising;

first and second co-axial chambers defined by an inner cylindrical container wall and an outer cylindrical container wall enclosing predetermined volumes in said predetermined ratio for containing respective first and second components and said chambers defining a dispensing end;

first and second components of said two-component system, located in respective said chambers, said components having degrees of compressibilities substantially equalized with one another;

piston means moveable along said chambers for ejecting the respective components;

a dispensing end wall extending transversely of said chambers;

an elongated valve body formed on the outward side of said dispensing end wall said valve body;

a transverse generally frusto-conical valve recess formed in said valve body;

a first dispensing opening in said dispensing wall communicating between said inner chamber and said valve recess;

a second dispensing opening formed in said dispensing wall communicating between said outer chamber and said valve recess offset from said central axis of said inner chamber;

a boss formed on said valve body and defining an axis located along the central axis of said inner chamber said boss defining two generally parallel dispensing passageways;

a partition wall extending between said dispensing passageway whereby to keep said two components separate from one another;

first and second valve openings extending between said valve body and said boss, said first valve opening communicating with one of said dispensing passageways, and said second opening communicating with the other of said passageways, and said first and second valve openings being located on opposite sides of said axis of said boss and being sized in said predetermined ratio;

a valve plug member shaped and adapted to be received in said valve recess;

first and second valve conduits formed in said valve plug member, said first conduit being adapted to communicate between said first dispensing opening in said dispensing wall and said first valve opening, and said second conduit being adapted to communicate between said second dispensing opening and said second valve opening, and wherein said conduits are of unequal length, and wherein each of said conduits defines a pre-determined volume in said predetermined ratio;

air bleed openings in said piston means for bleeding air from said two containers during filling with said two components, and, abutment means formed on an exterior surface of said piston means adjacent each of said air bleed openings, said abutment means being formed of thermoplastic material, and being heat-deformed whereby to permanently seal said air bleed openings after filling, of said chambers with said components.

13. A dispenser cartridge containing two components of a two-component system, in a pre-determined ratio, said components having degrees of compressibility substantially equalized with one another, and comprising;

first and second co-axial chambers defined by an inner cylindrical container wall and an outer cylindrical container wall enclosing predetermined volumes in said predetermined ratio for containing respective first and second components and said chambers defining a dispensing end;

first and second components of said two-component system, located in respective said chambers, said components having degrees of compressibilities substantially equalized with one another;

piston means moveable along said chambers for ejecting the respective components;

a dispensing end wall extending transversely of said chambers;

an elongated valve body formed on the outward side of said dispensing end wall said valve body;

a transverse generally frusto-conical valve recess formed transversely in said valve body;

a first dispensing opening in said dispensing wall communicating between said inner chamber and said valve recess;

a second dispensing opening formed in said dispensing wall communicating between said outer chamber and said valve recess offset from said central axis of said inner chamber;

a boss formed on said valve body and defining an axis located along the central axis of said inner chamber said boss defining two generally parallel dispensing passageways;

a partition wall extending between said dispensing passageways whereby to keep said two components separate from one another;

first and second valve openings extending between said valve body and said boss, said first valve opening communicating with one of said dispensing passageways, and said second opening communicating with the other of said passageways, and said first and second valve openings being located on opposite sides of said axis of said boss and being sized in said predetermined ratio and wherein said first and second valve openings define rectangular shapes of predetermined open area, said predetermined open areas being unequal to one another;

a valve plug member of frusto-conical shape shaped and adapted to be received in said valve recess; and first and second valve conduits formed in said valve plug member, said first conduit being generally tapered from one end to the other and defining two ends and being adapted to communicate between said first dispensing opening in said dispensing wall and said first valve opening, and said second conduit being of regular cross-section along its length, and extending diagonally to the central axis of said inner chamber defining two ends and being adapted to communicate between said second dispensing opening and said second valve opening, and wherein said conduits are of unequal length, and wherein each of said conduits defines a predetermined volume in said predetermined ratio.

* * * * *